US009068322B2

(12) United States Patent
Park et al.

(10) Patent No.: US 9,068,322 B2
(45) Date of Patent: Jun. 30, 2015

(54) DOUBLE CHECK VALVE FOR CONSTRUCTION EQUIPMENT

(75) Inventors: Sung-Bok Park, Changwon-si (KR); Se-Rib Jee, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 404 days.

(21) Appl. No.: 13/639,949

(22) PCT Filed: May 18, 2010

(86) PCT No.: PCT/KR2010/003122

§ 371 (c)(1),
(2), (4) Date: Oct. 8, 2012

(87) PCT Pub. No.: WO2011/145759

PCT Pub. Date: Nov. 24, 2011

(65) Prior Publication Data

US 2013/0055886 A1 Mar. 7, 2013

(51) Int. Cl.
*F15B 13/042* (2006.01)
*E02F 9/22* (2006.01)
*F15B 13/01* (2006.01)

(52) U.S. Cl.
CPC ..... *E02F 9/2207* (2013.01); *E02F 9/2267* (2013.01); *F15B 13/015* (2013.01); *F15B 2211/3051* (2013.01); *F15B 2211/761* (2013.01)

(58) Field of Classification Search
CPC ..... F15B 13/015; F15B 2211/3051; E02F 9/2267
USPC ..... 91/420, 445, 447
See application file for complete search history.

(56) References Cited

U.S. PATENT DOCUMENTS 3,274,902 A 9/1966 Kleckner
3,908,515 A * 9/1975 Johnson ..... 91/420

(Continued)

FOREIGN PATENT DOCUMENTS

EP 0025107 A1 3/1981
EP 2048372 A2 4/2009

(Continued)

OTHER PUBLICATIONS

Supplementary European Search Report mailed Jul. 19, 2013 corresponding to European Application No. 10851806.9, 4 pages.

(Continued)

*Primary Examiner* — Michael Leslie
(74) *Attorney, Agent, or Firm* — Harness, Dickey & Pierce, P.L.C.

(57) ABSTRACT

An improved double check valve for a construction machine is provided, which can greatly reduce noise and hunting phenomenon by making check valves open and close within a predetermined time difference to correspond to pressure drops that occur due to an external load when a dozer blade working device is operated. The double check valve includes a hydraulic pump; a hydraulic cylinder connected to the hydraulic pump to drive a working device; a control valve installed in a flow path between the hydraulic pump and the hydraulic cylinder and shifted to control a start, a stop, and a direction change of the hydraulic cylinder; a pair of pistons installed on one side of a piston cylinder to open and close first flow paths and second flow paths provided between the control valve and the hydraulic cylinder, provided with plunger ground portions and notch portions, respectively, and dividedly formed to be shifted in opposite directions to each other when signal pressure that is introduced from any one of the first and second flow paths acts on check hydraulic pressure portions during temporary descending of the working device; a pair of check valves of which checking functions are released when the check valves are pressed through the shifting of the pistons; and a plunger installed inside the piston cylinder to move the pistons in a checking function release direction of the check valves while a flow rate of hydraulic fluid, having passed through the notch portions, forms pressure in the plunger ground portions of the pistons.

4 Claims, 4 Drawing Sheets

(56) References Cited

U.S. PATENT DOCUMENTS

| | | | | |
|---|---|---|---|---|
| 4,286,432 | A * | 9/1981 | Burrows et al. | 91/420 |
| 4,343,153 | A * | 8/1982 | Kern et al. | 60/460 |
| 4,461,314 | A | 7/1984 | Kramer | |
| 4,506,700 | A | 3/1985 | Kramer | |
| 6,997,210 | B2 * | 2/2006 | Horn et al. | 91/420 |
| 7,254,945 | B1 * | 8/2007 | Sakai et al. | 91/420 |
| 8,001,882 | B2 * | 8/2011 | Hyang | 91/437 |
| 2008/0121101 | A1 | 5/2008 | Park | |
| 2009/0078111 | A1 | 3/2009 | Hyang | |

FOREIGN PATENT DOCUMENTS

| | | |
|---|---|---|
| JP | 52-014221 | 2/1977 |
| JP | 56-099161 | 8/1981 |
| JP | 63-017377 | 2/1988 |
| JP | 63-021115 | 2/1988 |
| JP | 08-247313 | 9/1996 |
| KR | 10-0849500 B1 | 7/2008 |
| KR | 10-0915206 B1 | 9/2009 |

OTHER PUBLICATIONS

Office Action dated Mar. 4, 2014 corresponding to Japanese Application No. 2013-511090, 4 pages.

Written Opinion of the International Searching Authority (in Korean) for PCT/KR2010/003122, mailed Feb. 21, 2011; ISA/KR.

International Preliminary Report on Patentability (Chapter II of the Patent Cooperation Treaty) for PCT/KR2010/003122 (in Korean), Issued Aug. 27, 2012.

International Search Report (in Korean with English Translation) for PCT/KR2010/003122, mailed Feb. 21, 2011; ISA/KR.

* cited by examiner

DOUBLE CHECK VALVE FOR CONSTRUCTION EQUIPMENT

TECHNICAL FIELD

The present invention relates to an improved double check valve for a construction machine, which can greatly reduce noise and hunting phenomenon by delaying the opening and closing of the check valve to correspond to a pressure change that occurs due to an external load when an excavator with a dozer blade working device is operated on a slope.

BACKGROUND ART

A construction machine including a dozer in the related art, as shown in FIG. 1, is configured so that a large chamber d1 and a small chamber d2 of a hydraulic cylinder d communicate with each other by a pipe h in order to drive a dozer blade that is a working device. In this case, a double check valve is used to prevent neutral oil leakage of the hydraulic cylinder d which may occur when the equipment is fixed to the ground using the dozer blade of the construction machine.

As illustrated in FIGS. 2 and 3, the construction machine that adopts the double check valve in the related art includes a hydraulic pump P; a hydraulic cylinder d connected to the hydraulic pump P to drive a dozer blade f; a control valve a installed in a flow path between the hydraulic pump P and the hydraulic cylinder d and shifted to control a start, a stop, and a direction change of the hydraulic cylinder d; a pair of check valves b and c installed to open and close a flow path between the control valve a and the hydraulic cylinder d and supported by pressure pieces f1 and f2 elastically supported by first and second elastic members e1 and e2; and a double check valve k preventing sinking of the dozer blade f by a plunger h that is slidably installed between the check valves b and c.

The elastic members e1 and e2 may typically be compression coil springs having elastic force against hydraulic pressure.

Referring to FIG. 3, the operation principle of the double check valve k in the related art will be described.

First, in the case where the control valve a is kept in a neutral state, a checking function is performed by the check valves b and c that are elastically supported by the first and second elastic members e1 and e2 and the pressure pieces f1 and f2 if the dozer blade f temporarily descends.

That is, the first flow paths s1 and s3, which make the control valve a and a small chamber d2 of the hydraulic cylinder d communicate with each other, are intercepted by the check valve b, and the second flow paths s2 and s4, which make the control valve a and a large chamber d1 of the hydraulic cylinder d communicate with each other, are intercepted by the check valve c.

Accordingly, hydraulic fluid from the hydraulic pump P is not supplied to the hydraulic cylinder d. Further, hydraulic fluid from the hydraulic cylinder d does not return to a hydraulic tank.

Accordingly, the dozer blade f is prevented from sinking by the weight of the dozer blade itself.

On the other hand, if the control valve a is shifted in the right direction as shown in FIG. 3 by signal pressure or pilot signal pressure that is supplied from an outside, the hydraulic fluid from the hydraulic pump P flows into the first flow path s1 of the double check valve k through the control valve a.

The hydraulic fluid of the first flow path s1 acts on a hydraulic pressure portion n1 to shift the plunger h in the left direction in the drawing, and presses the check valve b in the right direction in the drawing to release the checking function (at this time, the first elastic member e1 receives a compression force). That is, the first flow paths s1 and s3 of the double check valve k communicate with each other.

At this time, due to the shifting of the plunger h, the check valve c is pushed in the left direction in the drawing to release the checking function (at this time, the second elastic member e2 receives the compression force). That is, the second flow paths s2 and s4 of the double check valve k communicate with each other.

Through this, the hydraulic fluid from the hydraulic pump P passes through the control valve a and the first flow paths s1 and s3 of the double check valve k in order and is supplied to the small chamber d2 of the hydraulic cylinder d. At this time, the hydraulic fluid discharged from the large chamber d1 of the hydraulic cylinder d1 passes through the check valve c of which the checking function has been released, the second flow paths s2 and s4 of the double check valve k, and the control valve a in order, and returns to the hydraulic tank.

Accordingly, the hydraulic cylinder d is driven to contract by the hydraulic fluid supplied from the hydraulic pump P.

By contrast, as illustrated in FIG. 3, if the control valve a is shifted in the left direction in the drawing by the signal pressure supplied from the outside, the hydraulic fluid from the hydraulic pump P passes through the control valve a and makes the second flow paths s2 and s4 of the double check valve k communicate with each other. Accordingly, the hydraulic fluid discharged from the small chamber d2 of the hydraulic cylinder d passes through the check valve b of which the checking function has been released, the first flow paths s1 and s3 of the double check valve k, and the control valve a in order, and returns to the hydraulic tank.

Accordingly, the hydraulic cylinder d is driven to expand by the hydraulic fluid supplied from the hydraulic pump P.

However, the double check valve in the related art has the problem that the check valve repeats an abrupt opening and closing operation by an external load to cause the occurrence of noise and hunting phenomenon.

For example, when the hydraulic pressure presses an inlet port of the first flow path s1, the check valve c of the second flow path s4 is opened, and in this case, due to the weight of the working device, the small chamber side of the hydraulic cylinder a temporarily expands at high speed and the large chamber side contracts at high speed.

At this time, the pressure on the side of the second flow path s3 and the first flow path s1 is decreased, and the pressure on the side of the second flow path s4 is increased. Through this, the check valve c is closed by the pressure and the elastic force of the elastic member on the side of the second flow path s4, and thus the operation of the hydraulic cylinder a stops temporarily. Thereafter, since the flow rate is continuously supplied to the side of the first flow path s1 for the operation, the check valve c of the second flow path s4 is opened again and the hydraulic cylinder a starts its operation.

As a result, the double check valve for the construction machine in the related art has the problem that the check valve repeats the opening and closing operation until the equipment stops its operation and thus noise and hunting phenomenon occur frequently.

DISCLOSURE

Technical Problem

Therefore, the present invention has been made to solve the above-mentioned problems occurring in the related art, and one embodiment of the present invention is related to a double check valve for a construction machine, which can greatly reduce noise and hunting phenomenon by delaying opening and closing of the check valve to correspond to pressure drops that occur due to an external load when a working device is operated.

Technical Solution

In accordance with a first aspect of the present invention, there is provided a double check valve for a construction machine, which includes a hydraulic pump; a hydraulic cylinder connected to the hydraulic pump to drive a working device; a control valve installed in a flow path between the hydraulic pump and the hydraulic cylinder and shifted to control a start, a stop, and a direction change of the hydraulic cylinder; a pair of pistons installed on one side of a piston cylinder to open and close first flow paths and second flow paths provided between the control valve and the hydraulic cylinder, provided with plunger ground portions and notch portions, respectively, and dividedly formed to be shifted in opposite directions to each other when signal pressure that is introduced from any one of the first and second flow paths acts on check hydraulic pressure portions during temporary descending of the working device; a pair of check valves of which checking functions are released when the check valves are pressed through the shifting of the pistons; and a plunger installed inside the piston cylinder to move the pistons in a checking function release direction of the check valves while a flow rate of hydraulic fluid having passed through the notch portions forms pressure in the plunger ground portions of the pistons.

The plunger ground portions of the pistons may be installed to face each other on both sides of the plunger in the piston cylinder, and hydraulic pressure surfaces of the plunger ground portions may be formed greater than the check hydraulic pressure portions.

The double check valve according to the first aspect of the present invention may further include a housing in which the first flow paths that make the control valve and a small chamber of the hydraulic cylinder mutually communicate with each other and the second flow paths that make the control valve and a large chamber of the hydraulic cylinder mutually communicate with each other are formed; a pressure piece pressing the check valve that opens and closes the first flow paths; a first elastic member elastically supporting the pressure piece so that interception of the first flow paths through the check valve is elastically biased in its initial state; a pressure piece pressing the check valve that opens and closes the second flow paths; and a second elastic member elastically supporting the pressure piece so that interception of the second flow paths through the check valve is elastically biased in its initial state.

In accordance with a second aspect of the present invention, there is provided a double check valve for a construction machine, which includes a hydraulic pump; a hydraulic cylinder connected to the hydraulic pump to drive a working device; a control valve installed in a flow path between the hydraulic pump and the hydraulic cylinder and shifted to control a start, a stop, and a direction change of the hydraulic cylinder; a pair of pistons installed on one side of a piston cylinder to open and close first flow paths and second flow paths provided between the control valve and the hydraulic cylinder, respective pistons having plunger ground portions and notch portions, and dividedly formed to be shifted in opposite directions to each other when signal pressure that is introduced from any one of the first and second flow paths acts on check hydraulic pressure portions during temporary descending of the working device; a pair of check valves of which checking functions are released when the check valves are pressed through the shifting of the pistons; a plunger installed inside the piston cylinder to move the pistons in a checking function release direction of the check valves while a flow rate of hydraulic fluid having passed through the notch portions forms pressure in the plunger ground portions of the pistons; and a seating groove formed on one side of the plug, and a stopper formed on one side of an interior of the piston cylinder to be coupled to the seating groove so as to limit movement of the plug.

Advantageous Effect

The double check valve for a construction machine according to the aspects of the present invention has the following advantages.

With respect to an abrupt pressure drop that temporarily occurs due to the weight of the working device or an external load when the working device operates, the pistons operate slowly to delay the opening and closing of the check valves.

Further, while the checking function is performed, the drawback of the construction machine in the related art, in which the hydraulic cylinder stops its operation when the external load occurs, impact, noise, and hunting phenomenon are greatly reduced, and thus the workability and reliability of the equipment can be improved.

BRIEF DESCRIPTION OF THE DRAWINGS

The above objects, other features and advantages of the present invention will become more apparent by describing the preferred embodiments thereof with reference to the accompanying drawings, in which.

BEST MODE

Figure 1:
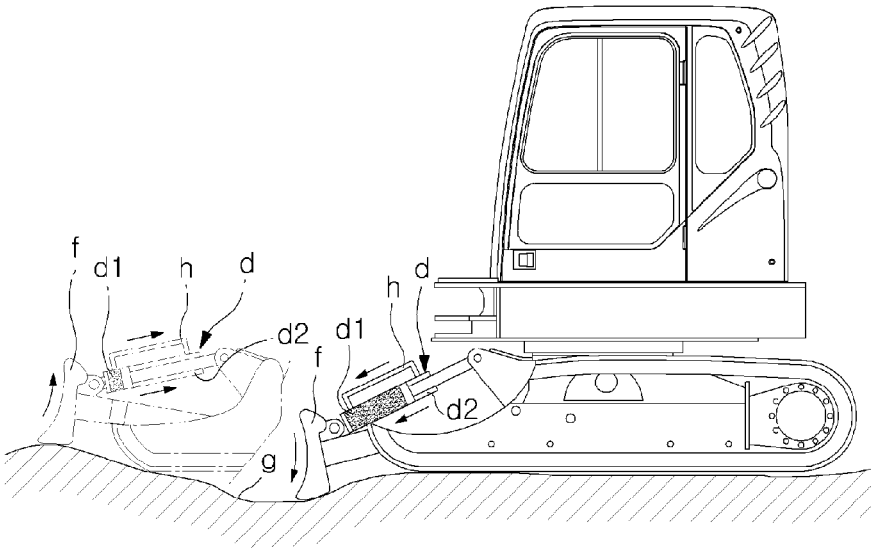
FIG. 1 is a schematic view illustrating a heavy construction machine on which a dozer blade working device is installed.
Figure 2:
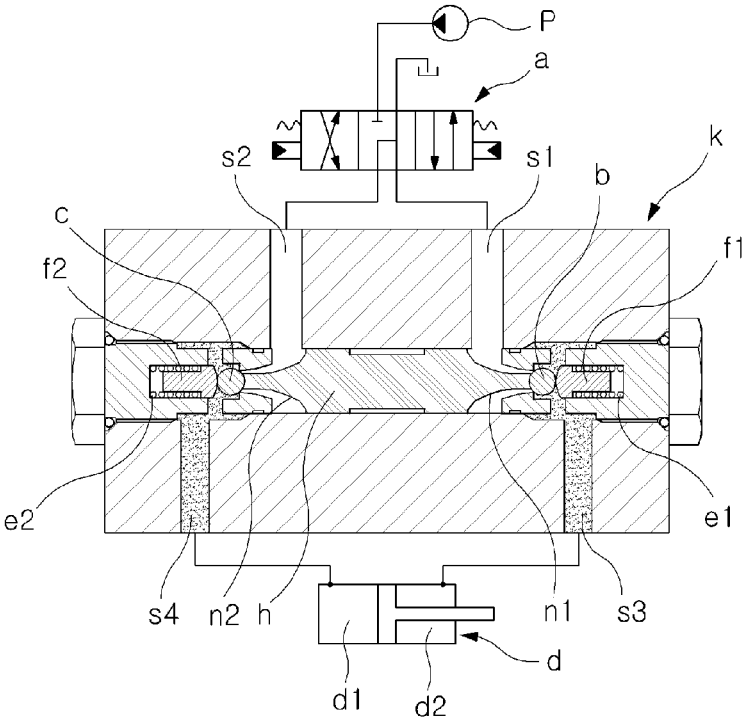
FIG. 2 is a hydraulic circuit diagram schematically illustrating a double check valve for a construction machine in the related art.
Figure 3:
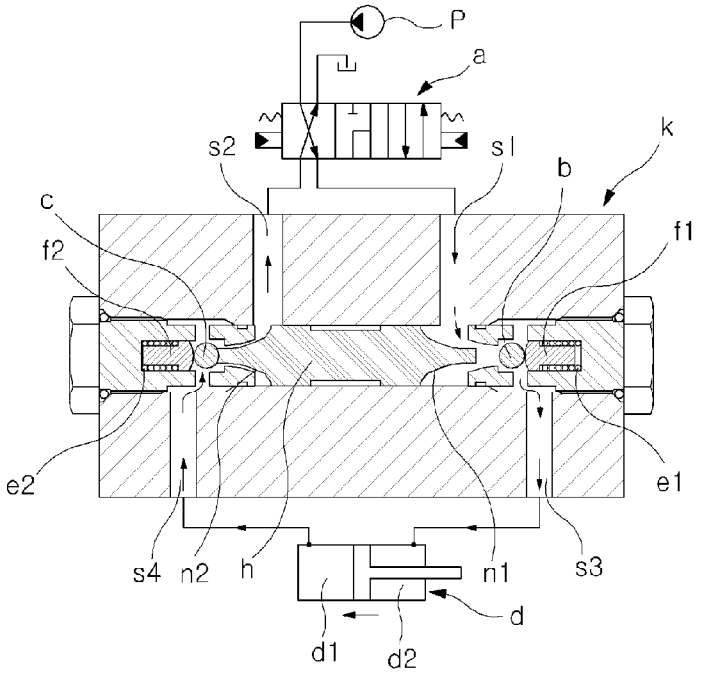
FIG. 3 is a view illustrating the use state of the double check value for a construction machine in the related art illustrated in FIG. 2.
Figure 4:
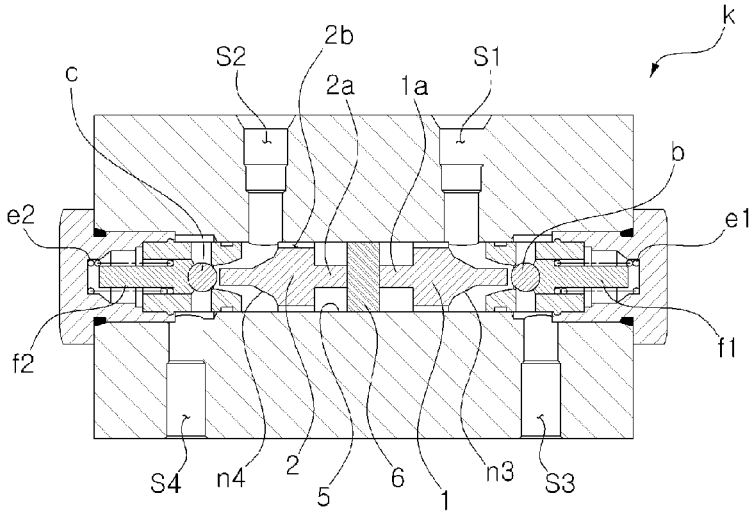
FIG. 4 is a cross-section view of a double check valve for a construction machine according to an embodiment of the present invention.
Figure 5:
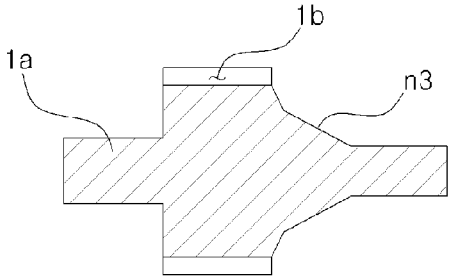
FIG. 5 is a cross-sectional view illustrating a piston (left piston in the drawing) according to an embodiment of the present invention.
Figure 6:
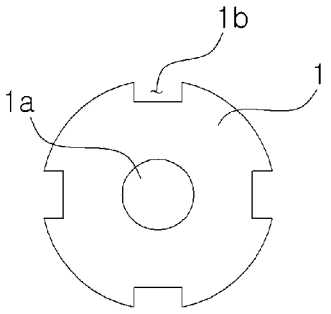
FIG. 6 is a right side view of the piston illustrated in FIG. 5.

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Referring to FIGS. 4 to 9, a double check valve k for a construction machine according to an embodiment of the present invention includes a hydraulic pump P; a hydraulic cylinder d connected to the hydraulic pump P to drive a working device; a control valve a installed in a flow path between the hydraulic pump P and the hydraulic cylinder d and shifted to control a start, a stop, and a direction change of the hydraulic cylinder d; a pair of pistons 1 and 2 installed on one side of a piston cylinder 5 to open and close first flow paths s1 and s3 and second flow paths s2 and s4 provided between the control valve a and the hydraulic cylinder d, provided with plunger ground portions 1*a* and 2*a* and notch portions 1*b* and 2*b*, respectively, and dividedly formed to be shifted in opposite directions to each other when signal pressure that is introduced from any one of the first and second flow paths s1, s2, s3, and s4 acts on check hydraulic pressure portions n3 and n4 during temporary descending of the working device; a pair of check valves b and c of which checking functions are released when the check valves b and c are pressed through the shifting of the pistons 1 and 2; and a plunger 6 installed inside the piston cylinder 5 to move the pistons 1 and 2 in a checking function release direction of the check valves b and c while a flow rate of hydraulic fluid having passed through the notch portions 1*b* and 2*b* forms pressure in the plunger ground portions 1*a* and 2*a* of the pistons 1 and 2.

It is preferable that the plunger ground portions 1*a* and 2*a* of the pistons 1 and 2 are installed to face each other on both sides of the plunger 6 in the piston cylinder 5, and hydraulic pressure surfaces of the plunger ground portions 1*a* and 2*a* are formed greater than the check hydraulic pressure portions n3 and n4. This is to consider that movement of the pistons 1 and 2 for releasing the checking function of the check valves b and c is made with a time difference.

The check valves b and c may be of a ball type or poppets.

The double check valve k, according to an embodiment of the present invention, further includes a housing m in which the first flow paths s1 and s3 that make the control valve a and a small chamber d2 of the hydraulic cylinder d mutually communicate with each other and the second flow paths s2 and s4 that make the control valve a and a large chamber d1 of the hydraulic cylinder d mutually communicate with each other are formed; a pressure piece f1 pressing the check valve b that opens and closes the first flow paths s1 and s3; a first elastic member e1 elastically supporting the pressure piece f1 so that interception of the first flow paths s1 and s3 through the check valve b is elastically biased in its initial state; a pressure piece f2 pressing the check valve c that opens and closes the second flow paths s2 and s4; and a second elastic member e2 elastically supporting the pressure piece f2 so that interception of the second flow paths s2 and s4 through the check valve c is elastically biased in its initial state.

In the coupling configuration of the plunger 6 and the pistons 1 and 2, the flow rate of hydraulic fluid having passed through the notch portions 1*b* and 2*b* forms pressure in a back pressure chamber 7 formed between the inside of the piston cylinder 5 and the plunger ground portion 3, and by the pressure in the back pressure chamber, the pistons 1 and 2 are configured to move in the checking function release direction of the check valves b and c.

As signal pressure for shifting the pistons 1 and 2, pilot signal pressure that is supplied from the hydraulic pump P to a signal pressure path (not illustrated), and the double check valve k may be driven by the hydraulic fluid from the hydraulic pump P or air pressure supplied from a compressed air supply source (not illustrated).

Figure 10:
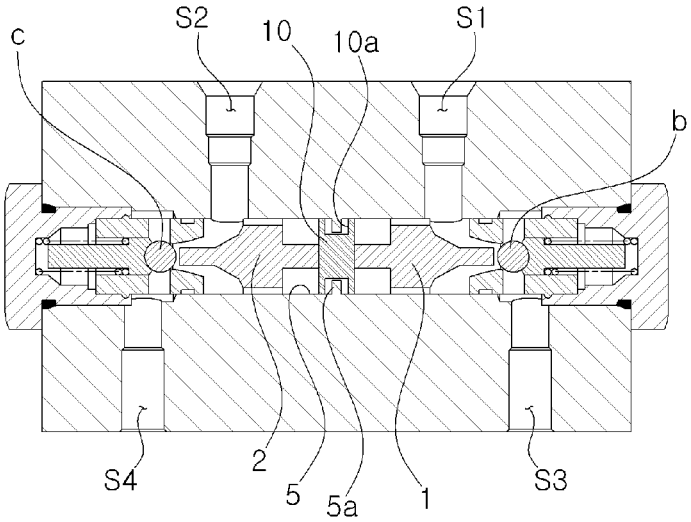
FIG. 10 is a cross-sectional view of a double check valve for a construction machine according to another example of the present invention.

On the other hand, as illustrated in FIG. 10, a double check valve for a construction machine, according to another embodiment of the present invention, includes a hydraulic pump P; a hydraulic cylinder d connected to the hydraulic pump P to drive a working device; a control valve a installed in a flow path between the hydraulic pump P and the hydraulic cylinder d and shifted to control a start, a stop, and a direction change of the hydraulic cylinder d; a pair of pistons 1 and 2 installed on one side of a piston cylinder 5 to open and close first flow paths s1 and s3 and second flow paths s2 and s4 provided between the control valve a and the hydraulic cylinder d, provided with plunger ground portions 1*a* and 2*a* and notch portions 1*b* and 2*b*, respectively, and dividedly formed to be shifted in opposite directions to each other when signal pressure that is introduced from any one of the first and second flow paths s1, s2, s3, and s4 acts on check hydraulic pressure portions n3 and n4 during temporary descending of the working device; a pair of check valves b and c of which checking functions are released when the check valves b and c are pressed through the shifting of the pistons 1 and 2; a plunger 6 installed inside the piston cylinder 5 to move the pistons 1 and 2 in a checking function release direction of the check valves b and c while a flow rate of hydraulic fluid having passed through the notch portions 1*b* and 2*b* forms pressure in the plunger ground portions 1*a* and 2*a* of the pistons 1 and 2; and a seating groove 10*a* formed on one side of the plunger 10, and a stopper 5*a* formed on one side of an interior of the piston cylinder 5 to be coupled to the seating groove 10*a* so as to limit movement of the plunger 10.

The stopper 5*a* functions to support the pressure of the plunger 10 and the back pressure chamber when the pistons 1 and 2 move in the checking function release direction of the check valves b and c as the flow rate, having passed through the notch portions 1*b* and 2*b*, forms the pressure in the plunger ground portions 1*a* and 2*a*.

When the hydraulic pressure is formed in the back pressure chamber 7 through the notch portions, the back pressure acts as ground portion hydraulic pressure on the ground portions 1*a* and 2*a* of the plunger 10, and then acts as pressure that pushes the check hydraulic pressure portions n3 and n4 of the pistons 1 and 2. Accordingly, it can be understood that one side of the check hydraulic pressure portion n3 and n4 of the pistons 1 and 2 acts as the checking function release pressure of the check valve b or c with a predetermined time difference.

Hereinafter, the use example of the double check valve for a construction machine according to an embodiment of the present invention will be described.

Figure 7:
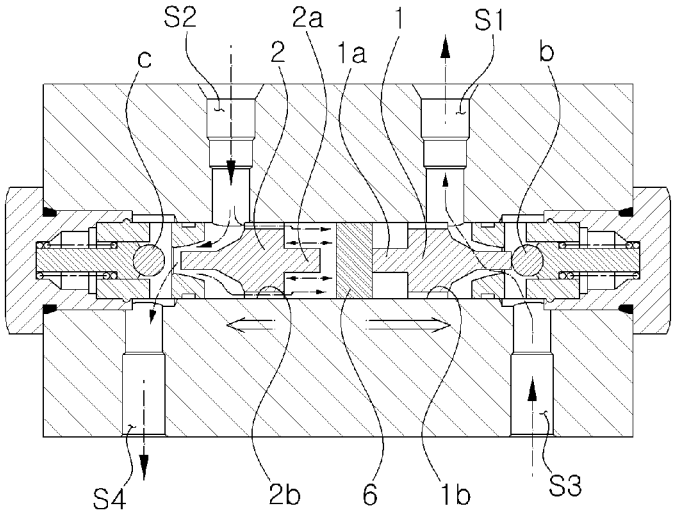
FIG. 7 is a cross-sectional view of a double check valve for a construction machine in a neutral state.
Figure 8:
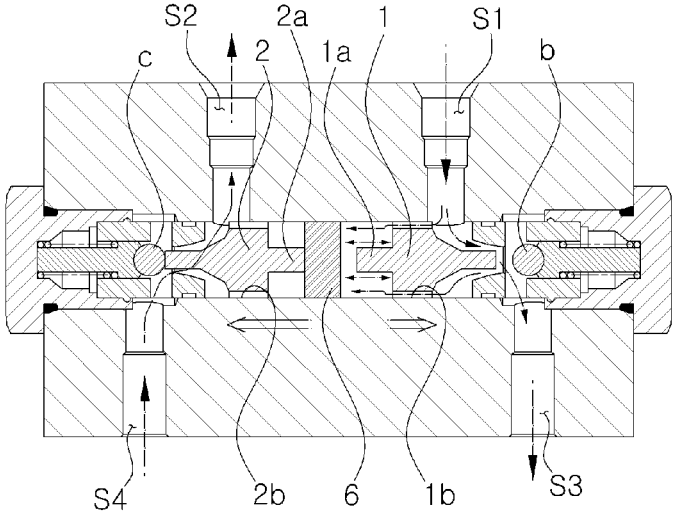
FIG. 8 is a view illustrating the use state of a double check valve for a construction machine that performs a checking function when hydraulic fluid is pressed in a first flow path according to an embodiment of the present invention.
Figure 9:
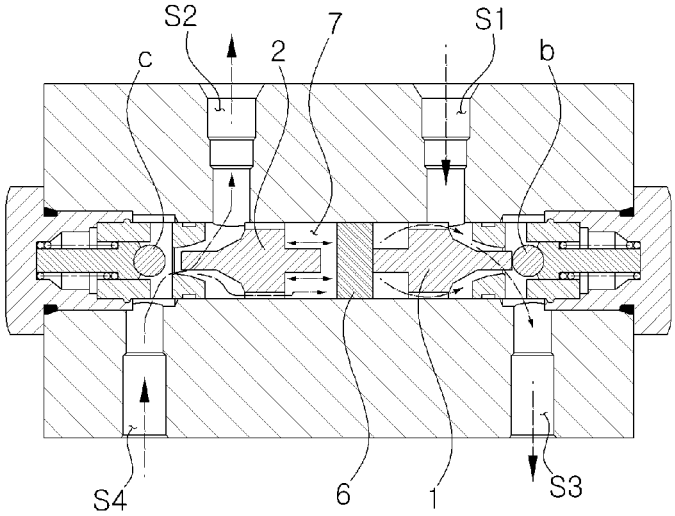
FIG. 9 is a view illustrating the use state of a double check valve for a construction machine that performs a checking function with a time difference when the pressure of a first flow path is lowered and the pressure of a second flow path is increased due to occurrence of an external load.

As illustrated in FIGS. 7 to 9, in the case where the control valve a is kept in a neutral state, double check valve k performs a checking function through the check valves b and c that are elastically supported by the first and second elastic members e1 and e2 and the pressure pieces f1 and f2. At this time, the pair of pistons 1 and 2 that are dividedly formed are maintained to be adjacent to the ground portions 1*a* and 2*a* and the plunger 6.

That is, the first flow paths s1 and s3, which make the control valve a and a small chamber d2 of the hydraulic cylinder d communicate with each other, are intercepted by the check valve b, and the second flow paths s2 and s4, which make the control valve a and a large chamber d1 of the hydraulic cylinder d communicate with each other, are intercepted by the check valve c.

Accordingly, hydraulic fluid from the hydraulic pump P is not supplied to the hydraulic cylinder d. Further, hydraulic fluid from the hydraulic cylinder d does not return to a hydraulic tank.

The double check valve for a construction machine, according to the present invention, performs the checking function with a predetermined time difference if the working device sinks due to the weight of the working device or an external load that includes vibration and impact, or the control valve a is shifted by signal pressure supplied from the outside.

For example, as illustrated in FIG. 8, if the hydraulic fluid from the hydraulic pump P flows into the first flow path s1 in the right piston 1 in the drawing, the flow rate of hydraulic fluid that flows through the first flow path s1 passes through the notch portion 1*b* formed on the piston 1 and presses the piston ground portion 1*b* and the check hydraulic pressure portion n3. At this time, since the area of the check hydraulic pressure portion n3 is smaller than the area of the piston ground portion 1*b* on the opposite side, the right piston 1 moves to the right side to open the right check valve b.

Further, the flow rate of the hydraulic fluid that flows through the notch portion 1*b* of the piston 1 presses the right side surface of the plunger 6, and the plunger 6 moves to the left side together with the left piston 2 to open the left check valve c.

Accordingly, the hydraulic fluid of the first flow path s3 flows to the second flow path s2 through the check valve c.

On the other hand, referring to FIG. 9, in the case of a hydraulic cylinder for a dozer blade, when the dozer blade goes up after the equipment works, the double check valve k is opened and the dozer blade abruptly sinks or lowers due to the weight of the dozer blade. At this time, since the volume change of the hydraulic cylinder d becomes severe, the pressure of the first flow path s1 is abruptly decreased and the pressure of the second flow path s2 is increased, so that the double check valve k for the construction machine, according to the present invention, can be applied thereto.

That is, if the pressure of the first flow path s1 is decreased and the pressure of the second flow path s4 is increased by the abrupt sinking phenomenon due to the external load, the plunger 6 moves to the right side since the pressure on the left side is high and the pressure on the right side is low.

At this time, the hydraulic pressure in the back pressure chamber 7 between the right piston 1 and the plunger 6 may move to the right side, and this hydraulic pressure passes out through the notch portion 1*b* of the right piston 1. However since the size of the notch portion 1*b* is relatively small, the movement of the piston 1 to the left side is made with a predetermined time difference.

Further, although the left check valve c is intended to be closed due to the pressure of the second flow path s4 through the force of the second elastic member e2, the hydraulic pressure that is formed through the notch portion 2*b* of the left piston 2 acts on the right side of the piston 2 and the piston ground portion 2*a*, and the piston 2 moves to the left side in the drawing to open the check valve c.

Accordingly, even if an abrupt sinking phenomenon, in which the pressure on the side of the first flow path s1 is decreased and the pressure on the right side of the second flow path s4 is increased, occurs, the left check valve c is not abruptly closed, but is closed within the predetermined time difference.

In explaining the present invention, although not illustrated, even in the case where the pressure of the side of the second flow path s2 is decreased and the pressure on the left side of the first flow path s3 is increased, the right check valve b is not abruptly closed, but is closed within the predetermined time difference according to the above-described operation principle.

On the other hand, as illustrated in FIG. 10, according to another embodiment of the present invention, the plunger 10 is coupled to the stopper 5*a* formed inside the piston cylinder 5 and the movement of the plunger 10 is limited. For example, even if the pressure of the first flow path s1 is abruptly decreased and the pressure of the second flow path s2 is abruptly increased due to the severe volume change of the hydraulic cylinder d caused by the severe external load, the plunger 10 is supported by the stopper 5*a* so that the plunger 10 is unable to move severely to the right side.

In this case, since the size of the notch portion 1*b* of the plunger 10 is relatively small, the movement of the piston 1 to the right side is performed with the predetermined time difference. Further, although the left check valve c is intended to be closed due to the pressure of the second flow path s4 through the force of the second elastic member e2, the hydraulic pressure that is formed through the notch portion 2*b* of the left piston 2 acts as the hydraulic pressure of the piston ground portion 2*a*, and the piston 2 moves to the left side in the drawing to open the check valve c. Accordingly, even if the abrupt sinking phenomenon occurs, the check valve c is not abruptly closed, but is closed with the predetermined time difference in the same manner as described above.

INDUSTRIAL APPLICABILITY

As apparent from the above description, according to the double check valve for the construction machine, according to the embodiments of the present invention, if the pressure drop occurs due to the external load while the checking function is performed, the check valves b and c are not immediately closed, but the pistons 1 and 2 move with some time difference to performs the checking function.

Accordingly, not only the drawback of the construction machine in the related art, in which the hydraulic cylinder stops its operation when the external load occurs, but also impact, noise, and hunting phenomenon can be greatly reduced.

The invention claimed is:

1. A double check valve for a construction machine comprising:

a hydraulic pump;

a hydraulic cylinder connected to the hydraulic pump to drive a working device;

a control valve installed in a flow path between the hydraulic pump and the hydraulic cylinder and shifted to control a start, a stop, and a direction change of the hydraulic cylinder;

a pair of pistons installed on one side of a piston cylinder to open and close first flow paths and second flow paths provided between the control valve and the hydraulic cylinder, provided with plunger ground portions and notch portions, respectively, and dividedly formed to be shifted in opposite directions to each other when signal pressure that is introduced from any one of the first and second flow paths acts on check hydraulic pressure portions during temporary descending of the working device;

a pair of check valves of which checking functions are released when the check valves are pressed through the shifting of the pistons; and a plunger installed inside the piston cylinder to move the pistons in a checking function release direction of the check valves while a flow rate of hydraulic fluid, having passed through the notch portions, forms pressure in the plunger ground portions of the pistons.

2. The double check valve for a construction machine, according to claim 1, wherein the plunger ground portions of the pistons are installed to face each other on both sides of the plunger in the piston cylinder, and hydraulic pressure surfaces of the plunger ground portions are formed greater than the check hydraulic pressure portions.

3. The double check valve for a construction machine, according to claim 1, further comprising:

a housing in which the first flow paths that make the control valve and a small chamber of the hydraulic cylinder mutually communicate with each other and the second flow paths that make the control valve and a large chamber of the hydraulic cylinder mutually communicate with each other are formed;

a pressure piece pressing the check valve that opens and closes the first flow paths;

a first elastic member elastically supporting the pressure piece so that interception of the first flow paths through the check valve is elastically biased in its initial state;

a pressure piece pressing the check valve that opens and closes the second flow paths; and a second elastic member elastically supporting the pressure piece so that interception of the second flow paths through the check valve is elastically biased in its initial state.

4. A double check valve for a construction machine comprising:

a hydraulic pump;

a hydraulic cylinder connected to the hydraulic pump to drive a working device;

a control valve installed in a flow path between the hydraulic pump and the hydraulic cylinder and shifted to control a start, a stop, and a direction change of the hydraulic cylinder;

a pair of pistons installed on one side of a piston cylinder to open and close first flow paths and second flow paths provided between the control valve and the hydraulic cylinder, provided with plunger ground portions and notch portions, respectively, and dividedly formed to be shifted in opposite directions to each other when signal pressure that is introduced from any one of the first and second flow paths acts on check hydraulic pressure portions during temporary descending of the working device;

a pair of check valves of which checking functions are released when the check valves are pressed through the shifting of the pistons;

a plunger installed inside the piston cylinder to move the pistons in a checking function release direction of the check valves while a flow rate of hydraulic fluid, having passed through the notch portions, forms pressure in the plunger ground portions of the pistons; and a seating groove formed on one side of the plug, and a stopper formed on one side of an interior of the piston cylinder to be coupled to the seating groove so as to limit the movement of the plug.

* * * * *